US006050240A

United States Patent [19]

Saiki et al.

[11] Patent Number: 6,050,240

[45] Date of Patent: Apr. 18, 2000

[54] ELECTRONIC FUEL INJECTION APPARATUS FOR DIESEL ENGINE

[75] Inventors: Suzuhiro Saiki; Tadashi Uchiyama, both of Kanagawa, Japan

[73] Assignee: Isuzu Motors Limited, Tokyo, Japan

[21] Appl. No.: 09/256,475

[22] Filed: Feb. 23, 1999

[30] Foreign Application Priority Data

Feb. 24, 1998 [JP] Japan ..... 10-042027

[51] Int. Cl.[7] ..... F02D 31/00

[52] U.S. Cl. ..... 123/357; 123/179.17

[58] Field of Search ..... 123/179.17, 357, 123/446, 447, 358–359

[56] References Cited

U.S. PATENT DOCUMENTS 4,602,600 7/1986 Akatsuka ..... 123/179.17
5,181,494 1/1993 Ausman ..... 123/179.17
5,339,781 8/1994 Osawa ..... 123/357
5,357,912 10/1994 Barnes ..... 123/357
5,483,940 1/1996 Namba ..... 123/357
5,613,474 3/1997 Nakamura ..... 123/179.17
5,638,789 6/1997 Hayner ..... 123/357
5,771,861 6/1998 Musser ..... 123/357
5,775,304 7/1998 Kono ..... 123/357

*Primary Examiner*—Carl S. Miller
*Attorney, Agent, or Firm*—Staas & Halsey LLP

[57] ABSTRACT

An electronic fuel injection apparatus for a diesel engine comprising a driving state detection means for detecting a driving state of a vehicle and a controller for periodically determining a target injection quantity based on the driving state. When the driving state detection means indicates a state in a short time after engine start, a correction quantity which is preset to be added to the target injection quantity according to the engine temperature detected as the driving state is decreased, depending on time after engine start.

9 Claims, 5 Drawing Sheets

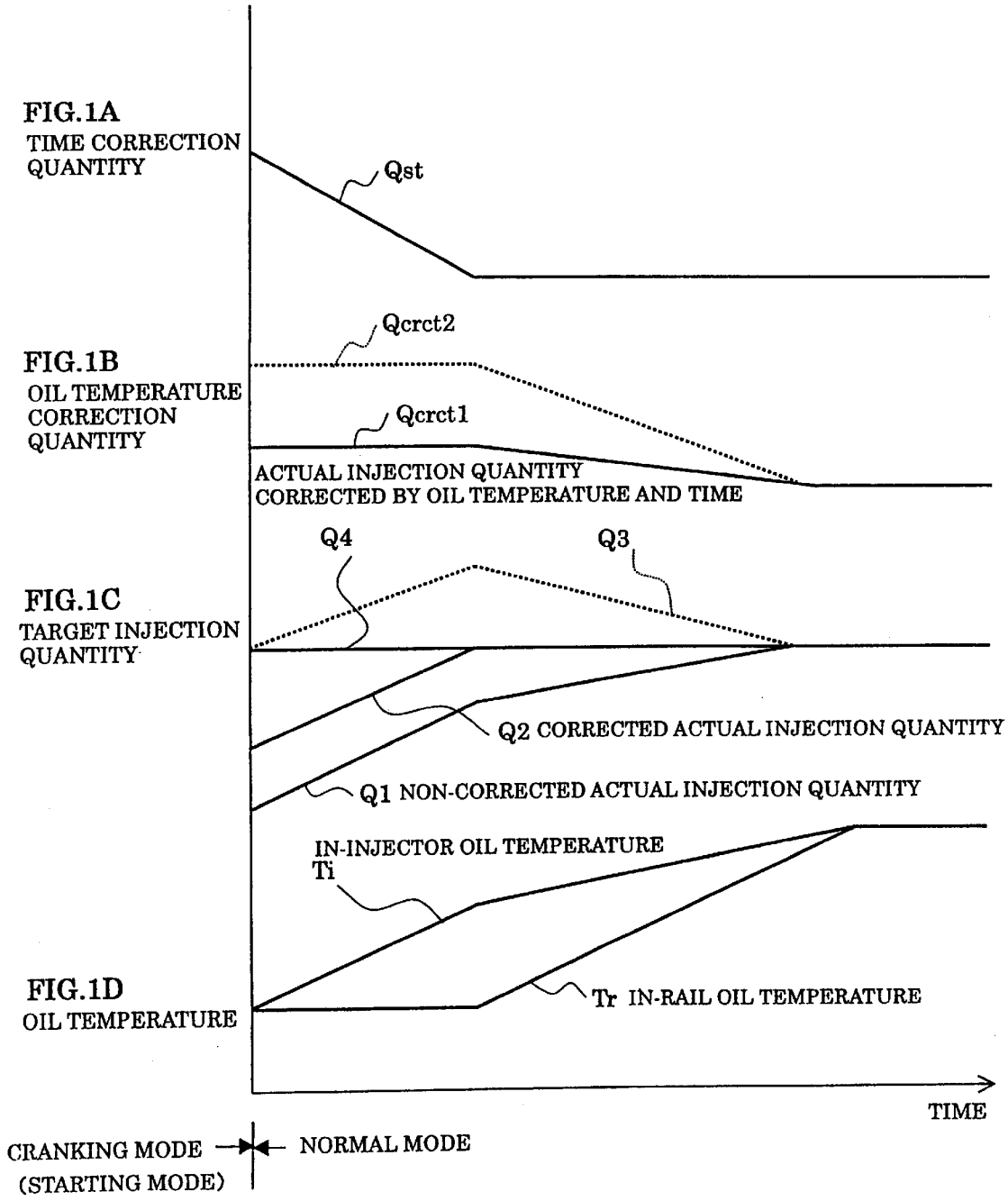
FIG.1A
TIME CORRECTION QUANTITY
Qst
FIG.1B
OIL TEMPERATURE CORRECTION QUANTITY
Qcrct2
Qcrct1
ACTUAL INJECTION QUANTITY CORRECTED BY OIL TEMPERATURE AND TIME
FIG.1C
TARGET INJECTION QUANTITY
Q4
Q3
Q2 CORRECTED ACTUAL INJECTION QUANTITY
Q1 NON-CORRECTED ACTUAL INJECTION QUANTITY
FIG.1D
OIL TEMPERATURE
IN-INJECTOR OIL TEMPERATURE
Ti
Tr IN-RAIL OIL TEMPERATURE
TIME
CRANKING MODE
(STARTING MODE)
NORMAL MODE

ELECTRONIC FUEL INJECTION APPARATUS FOR DIESEL ENGINE

BACKGROUND OF THE INVENTION

1. Field of the Invention

The present invention relates to an electronic fuel injection apparatus for a diesel engine, and in particular to an electronic fuel injection apparatus for a diesel engine which determines a target injection quantity based on a driving state of a vehicle.

2. Description of the Related Art

For a conventional electronic fuel injection apparatus for a diesel engine, not only an injection quantity and injection timing but also an injection pressure is important as a control parameter for an injector. Various electronically controlled apparatuses which can control the injection pressure have been thus developed.

For example, the published Japanese translation No. 6-511526 of PCT international publication for patent applications discloses a hydraulically (oil) actuated injector. In this injector, the pressure action of hydraulic fluid (engine oil) is controlled through an electronic device such as an electromagnetic valve which is internally provided, thereby controlling the fuel injection quantity and timing.

Namely, a fuel chamber formed within the injector is preliminarily supplied with fuel of relatively low pressure. Then, the fuel injection is performed by a controller which energizes the electromagnetic valve or opens the valve provided in a route through which high-pressure oil pressurized by a high-pressure oil pump to be accumulated within an oil rail is supplied to a pressured surface of a pressurizing plunger in the injector from the oil rail to actuate or give strokes to the pressurizing plunger.

Also, in this injector, by controlling the pressure of the hydraulic fluid (pressure within the oil rail) through a flow control valve provided in the high-pressure oil pump, the fuel injection pressure may be controlled.

Therefore, the controller calculates a target injection quantity, a target injection timing, and a target injection pressure corresponding to a driving state of the engine, thereby determining a duration and a timing for energizing the electromagnetic valve and the duty ratio of the flow control valve based on respective target values.

Besides, an electronic fuel injection apparatus which uses a fuel-actuated injector (injection valve) such as described in the Japanese Patent Publication No. 4-19381 is also well known. This injector has a pressure control chamber formed at the discharging side of a needle valve preliminarily supplied with high-pressure fuel, which is then leaked for the fuel injection in opposition to the above-mentioned published Japanese translation No. 6-511526.

Namely, the high-pressure fuel is pressurized by the high-pressure fuel pump and supplied to the tip of the needle valve and the above-mentioned pressure control chamber through an accumulator. The fuel injection is performed by energizing or opening the electromagnetic valve provided in a leak passage in the pressure control chamber.

In view of the target injection quantity among the above-mentioned control parameters, the injector described in the above-mentioned published Japanese translation No. 6-511526 may encounter a large fall or depression of an actual injection quantity (see a characteristic Q1 in FIG. 1C) with reference to the target injection quantity, and an unstable engine speed or engine stall at worst in a short time after engine start at low temperatures, i.e. immediately after the transition from the cranking mode to the completed explosion mode. This is because low temperatures also make the oil temperature low so that the oil becomes so highly viscid as not to pass through the opening of the electromagnetic valve whereby the electromagnetic valve is closed before the pressurizing plunger have its full stroke, leading to such a fall of the actual injection quantity.

In order to eliminate such a fall of the actual injection quantity, the published Japanese translation No. 6-511526 detects the oil temperature with an oil temperature sensor provided in the oil rail and corrects the target injection quantity particularly in the increasing direction at low temperatures or the energizing time. However, with only such corrections on oil temperature, the actual injection quantity corresponding to the target cannot be obtained in a short time after engine start at low temperatures as mentioned above.

This is because the rising rates of the actual oil temperature (fuel temperature) differs between the insides of the oil rail (or the accumulator) and the injector.

Namely, while the oil supplied to the injector is theoretically to be discharged out of the injector at each single injection, a considerable amount of the oil actually remains. Also, since the electromagnetic valve is actuated at a high speed inside the injector, the residual oil is stirred and the temperature rises quickly. However, the oil within the oil rail (in-rail oil) is gradually raised in temperature by the circulation thereof around the injector or parts of the engine.

Therefore, as shown in FIG. 1D, while a temperature Ti of the oil within the injector quickly rises in a short time after engine start, a temperature Tr of the oil within the oil rail hardly changes. Therefore, the controller assumes that the temperature is low in a short time after engine start and corrects the target injection quantity in the increasing direction.

Now assuming that for the fall of the actual injection quantity in a short time after engine start at low temperatures the target injection quantity is corrected in the increasing direction according to an oil temperature correction characteristic Qcrct1 shown by a solid line in FIG. 1B, namely the oil temperature correction quantity is set to be corrected after the oil temperature within the oil rail starts rising, the actual injection quantity in a short time after engine start becomes insufficient as shown by a characteristic Q2 in FIG. 1C, thereby causing the engine stall. Also, assuming that the target injection quantity is largely increased according to an oil temperature correction characteristic Qcrct2 as shown by a dotted line in FIG. 1B, the correction quantity becomes excessive as the oil temperature rises within the injector as shown by a characteristic Q3 of a dotted line in FIG. 1C and the fuel injection exceeds the target quantity, thereby causing the engine speed to abnormally rise or generate a large amount of white smoke.

Such problems may also arise in a fuel-actuated injector as described in the Japanese Patent Publication No. 4-19381 as well as the published Japanese translation No. 6-511526.

SUMMARY OF THE INVENTION

It is accordingly an object of the present invention to provide an electronic fuel injection apparatus for a diesel engine comprising a driving state detection means for detecting a driving state of a vehicle and a controller for periodically determining a target injection quantity based on the driving state in which a satisfactory correction of the target injection quantity is made based on an engine temperature in a short time after engine start.

For the achievement of the above-mentioned object, the controller in the electronic fuel injection apparatus for a diesel engine according to the present invention decreases a correction quantity which is preset to be added to the target injection quantity according to an engine temperature detected as the driving state, depending on time after engine start when the driving state indicates a state in a short time after engine start.

Namely, in the present invention, the target injection quantity in a short time after engine start at low temperatures is corrected in the increasing direction corresponding to an engine temperature and the correction quantity is gradually decreased according to the elapsed time shortly after engine start as shown by a characteristic Qst in FIG. 1A. As a result, as shown by a characteristic Q4 in FIG. 1C, a fall of the actual injection quantity in a short time after engine start which cannot be fully provided with the increased correction quantity according to the engine temperature may be prevented by adding thereto the correction quantity by time, thereby achieving a stable engine speed.

As for the above-mentioned engine temperature, not only a hydraulic fluid temperature but also a cooling water temperature may be used.

Also, the above-mentioned driving state detection means may detect a rotational speed and a load or an idling state of the engine as the driving state.

Moreover, the above-mentioned driving state detection means may comprise at least one of an intake pressure sensor for sensing an intake pressure of an intake pipe, a water temperature sensor for sensing an engine water temperature, and an intake temperature sensor for sensing an intake temperature of the intake pipe.

The electronic fuel injection apparatus for a diesel engine according to the present invention may further comprise an injector actuated by oil pressure or fuel pressure.

Also, the above mentioned controller may correct a pulse width of an injection command pulse for an electromagnetic valve disposed within an injector in order to control the target injection quantity.

BRIEF DESCRIPTION OF THE DRAWINGS

FIGS. 1A–1D are diagrams illustrating the principle of an electronic fuel injection apparatus for a diesel engine according to the present invention;

Throughout the figures, the same reference numerals indicate identical or corresponding portions.

DESCRIPTION OF THE EMBODIMENTS

Figure 2:
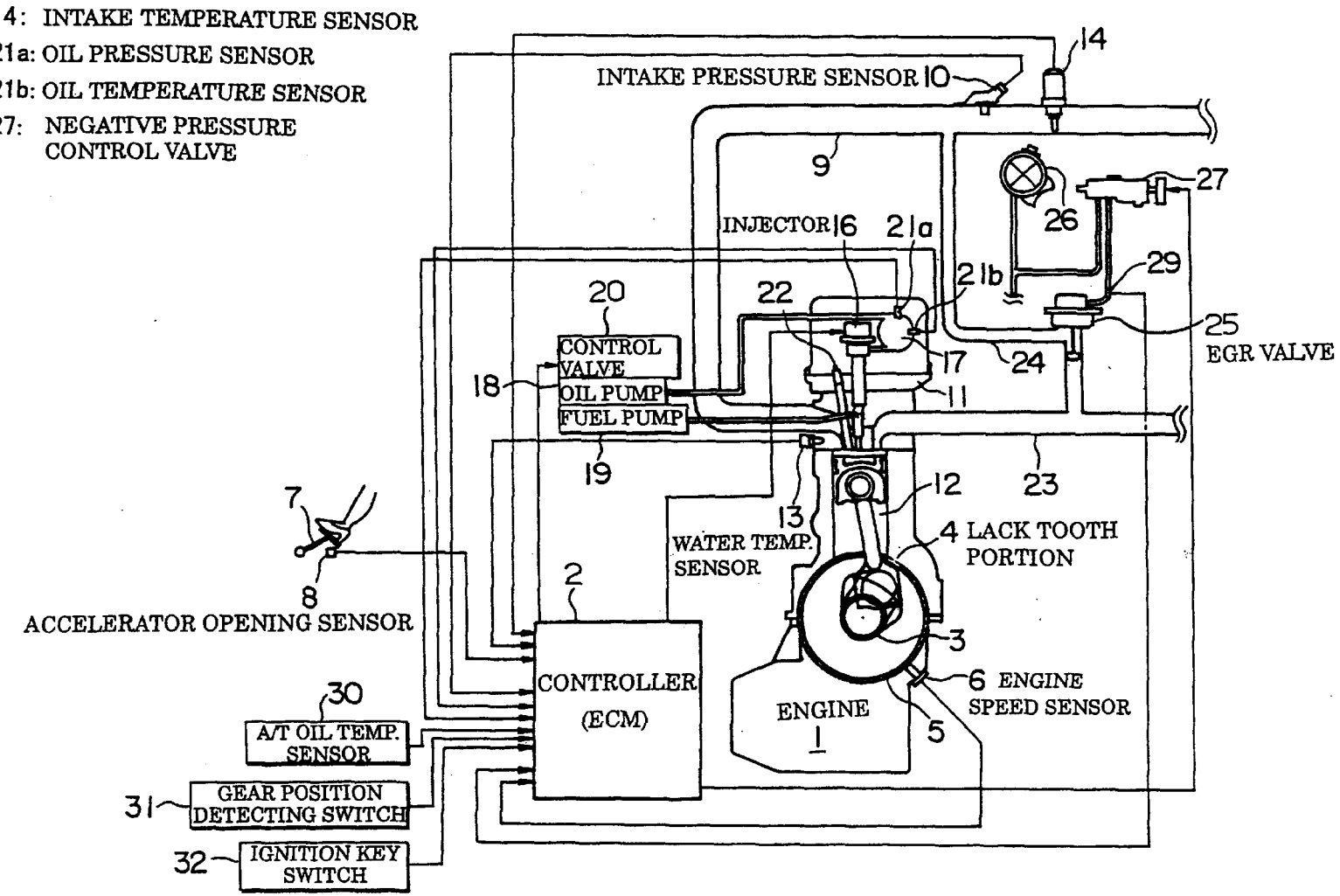
FIG. 2 is a block diagram illustrating an embodiment of an electronic fuel injection apparatus for a diesel engine according to the present invention.

FIG. 2 illustrates an embodiment of an electronic fuel injection apparatus for a diesel engine according to the present invention which is a system comprising a diesel engine 1, a four-cycle four-cylinder direct injection engine as an example, and a controller (ECM) 2 performing a fuel injection control according to output signals of various sensors provided in an intake system, exhaust system, and the like.

Specifically, an engine speed sensor 6 is composed of an electromagnetic pickup so as to be electromagnetically coupled with a regularly toothed wheel 5 having a lack tooth portion 4 which is fixed on a crankshaft 3 of the engine 1, detects a rotational speed (NE) of the engine 1, and gives the speed to the controller 2. Also, an accelerator opening (acceleration) sensor 8 is composed of a potentiometer, detects an operated or step-on quantity (an accelerator opening: ACL) of an accelerator pedal 7, and gives the accelerator opening quantity to the controller 2. The controller 2 changes an analog signal of the accelerator opening into a digital signal to be taken in. At least, the engine speed sensor 6 and the accelerator opening sensor 8 form a driving state detection means.

The driving state detection means preferably comprises sensors such as an intake pressure sensor 10 provided in a position shown in FIG. 2 for sensing an intake pressure of an intake pipe 9, a water temperature sensor 13 provided at a head 11 in an upper part of a cylinder 12 of the engine 1 for sensing an engine water temperature, and an intake temperature sensor 14 for sensing an intake temperature of an intake pipe 9 and is connected to the controller 2.

Also, a hydraulically actuated unit injector 16 is provided at the upper part of the cylinder 12 for fuel to be directly injected into the cylinder 12. To this injector 16 are supplied high-pressure oil from a high-pressure oil pump 18 through an oil rail 17 which is disposed beside the cylinder head 11 and low-pressure fuel from a fuel pump 19. The pressure of the high-pressure oil is controlled by the controller 2 through a control valve (RPCV) 20.

Namely, by supplying fuel of comparatively low pressure to a fuel chamber formed within the injector 16 from the fuel pump 19 and then pressurizing this fuel by a pressurizing plunger (not shown) which is actuated with high-pressure oil from the oil pump 18, the fuel injection is performed at an injection pressure which does not depend on the rotational speed of the engine. It is to be noted that the oil pressure (hydraulic pressure) at this time is detected by an oil pressure sensor 21*a*, and the oil temperature is detected by an oil temperature sensor 21*b*, which are fed back to the controller 2.

In the route which supplies the high-pressure oil of the oil pump 18 from the oil rail 17 to the pressured surface of the pressurizing plunger within the injector 16, an electromagnetic valve (not shown) is disposed. The fuel injection is performed by energizing or opening this electromagnetic valve with a control signal from the controller 2.

Namely, the controller 2 determines a duration (a pulse width or a duty ratio) for energizing the above-mentioned electromagnetic valve based on the target injection quantity and controls the fuel injection quantity from the injector 16 by energizing the above-mentioned electromagnetic valve by that pulse width.

It is to be noted that a glow plug 22 serves to assist the engine start.

An EGR (exhaust gas recirculation) pipe 24 is connected from an exhaust pipe 23 to the intake pipe 9 of the engine 1, which makes a part of the exhaust gas feed back to the intake side to reduce the combustion temperature of the engine 1, thereby decreasing a nitrogen oxide. An EGR valve 25 is provided in the middle of the EGR pipe 24. The lift of this EGR valve 25 is controlled by a control valve (EVRV) 27 which uses a negative pressure provided by a vacuum pump 26 and this lift (negative pressure) is detected by a sensor 29 to be given to the controller 2.

Moreover, an oil temperature sensor 30 provided in a position where a hydraulic oil temperature of an automatic transmission (not shown) can be detected, a gear position detecting switch 31 provided in a position where the position of a gearshift lever (not shown) can be detected, and a key switch 32 which detects the position of an ignition key are connected to the controller 2.

For more detailed explanations about this fuel injection control system, reference is made to the published Japanese translation No. 6-511526 as above noted.

Figure 3:
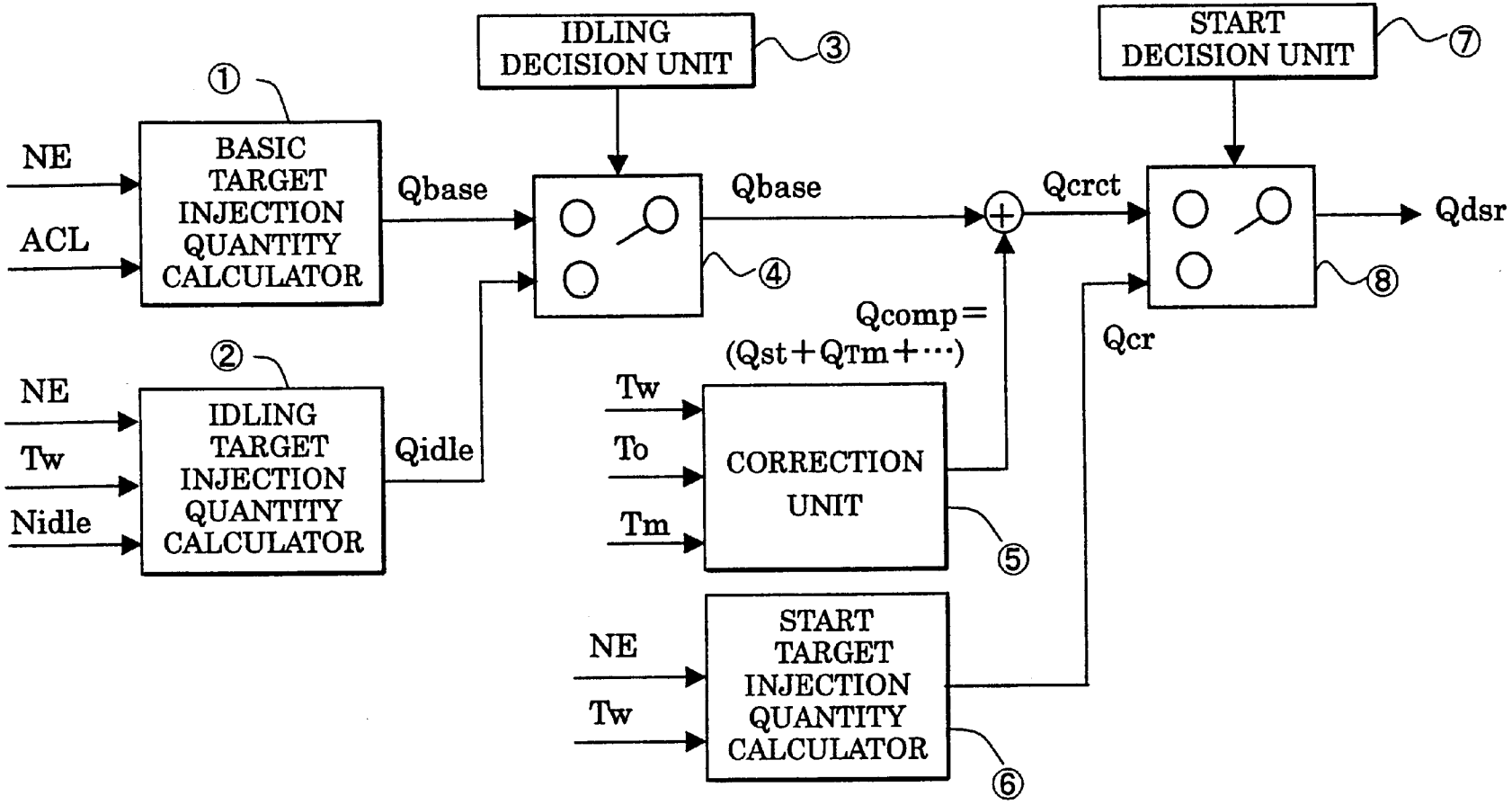
FIG. 3 is a block diagram schematically illustrating an operation of an electronic fuel injection apparatus for a diesel engine according to the present invention.

FIG. 3 illustrates a schematic diagram of a target injection quantity calculation by the controller 2.

First of all, a basic target injection quantity calculator $\hat{1}$ calculates a basic target injection quantity Qbase by making reference to a memory map (not shown) from an engine speed NE detected by the engine speed sensor 6 and the accelerator opening ACL detected by the accelerator opening sensor 8.

An idling target injection quantity calculator $\hat{2}$ corrects an idling target injection quantity Qfc corresponding to a water temperature Tw detected by the water temperature sensor 13 with a PID control method based on a deviation between the engine speed NE and an idling target engine speed Nidle to obtain an idling target injection quantity Qidle.

An idling decision unit $\hat{3}$ decides the present state to be an idling state when the engine speed NE resides within a predetermined low speed range and the accelerator opening ACL is equal to or smaller than a predetermined small opening (for example, 0%), and otherwise to be a non-idling state.

Then, a switching unit $\hat{4}$ selects the basic target injection quantity Qbase from the calculator $\hat{1}$ in case the idling decision unit $\hat{3}$ decides the present state to be the non-idling state and selects the idling target injection quantity Qidle from the calculator $\hat{2}$ in case of the idling state. The switching unit $\hat{4}$ outputs the target injection quantity Qbase or Qidle selected in either case, as the basic target injection quantity Qbase.

A correction unit $\hat{5}$ determines, in addition to a low temperature starting correction quantity Qst which is characteristic of the present invention, various correction quantities Qcomp such as an oil temperature correction quantity Qoil based on the water temperature Tw detected by the water temperature sensor 13 or an oil temperature To detected by the oil temperature sensor 21*b* and a correction quantity QTm based on an intake temperature Tm as disclosed in the published Japanese translation No. 6-511526.

By adding (subtracting in some cases) the above-mentioned correction quantity Qcomp to (from) the basic target injection quantity Qbase, the corrected target injection quantity Qcrct is obtained.

A start target injection quantity calculator $\hat{6}$ calculates a start target injection quantity Qcr by making reference to the memory map from the engine speed NE and the water temperature Tw.

A start decision unit $\hat{7}$ decides the present state to be a starting mode when the engine speed NE is equal to or lower than a predetermined engine speed at a completed explosion, and otherwise to be a normal mode (completed starting mode).

Finally, a switching unit $\hat{8}$ selects the correction target injection quantity Qcrct in case the start decision unit $\hat{7}$ decides it to be the starting mode and the start target injection quantity Qcr in case of the normal mode. The injection quantity Qcrct or Qcr which is calculated in each case is outputted as a final target injection quantity Qdsr.

The controller 2 periodically performs the calculation for each unit. Also, when a crank angle reaches a fixed angle (for example, BTDC40° CA) before the fuel injection in each cylinder, the controller decides the pulse width of the electromagnetic valve of the injector 16 based on the above-mentioned final target injection quantity Qdsr by an interruption process.

Figure 4:
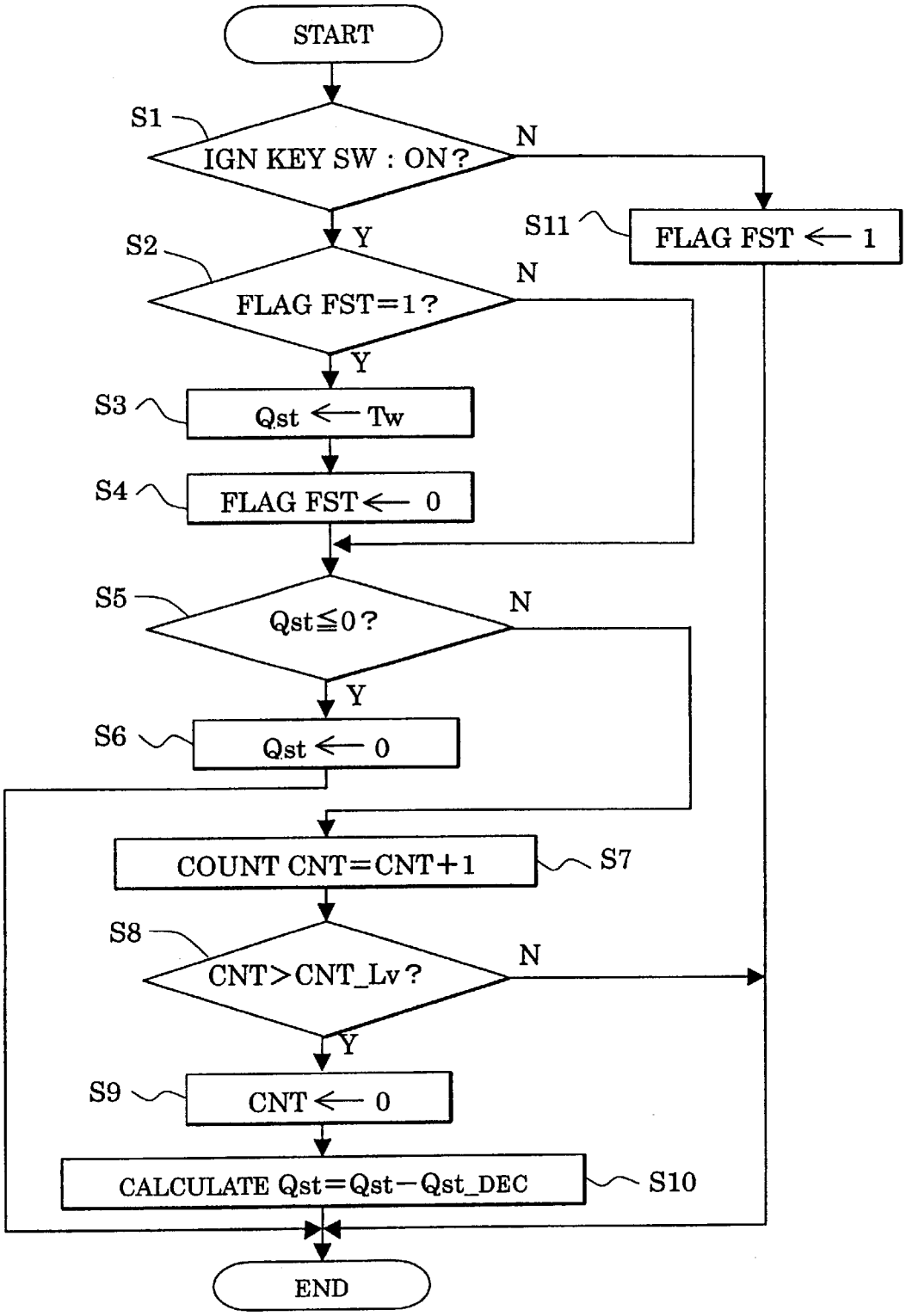
FIG. 4 is a flow chart illustrating a control program executed by a controller used in an electronic fuel injection apparatus for a diesel engine according to the present invention.

FIG. 4 illustrates a flow chart for calculating a low temperature start correction quantity Qst which is directly related to the present invention among the correction quantity Qcomp (=Qst+Qoil+QTm+. . . ) which is obtained by the correction unit $\hat{5}$ shown in FIG. 3.

Firstly, in step S1, an ON/OFF condition of the ignition key which is detected by the key switch part 32 is decided. If the condition of the key is ON, the routine proceeds to step S2 in which the condition of a low temperature start correction flag FST is checked.

Since this flag FST is initially set to "1" in step S11 when the ignition key is OFF, i.e. when the engine is stopped, this routine proceeds from step S2 to step S3 at the first execution. In step S3, the low temperature starting correction quantity Qst is obtained by making reference to the memory map from the water temperature Tw which is being read at that time. The quantity Qst is a correction quantity at that time of switch-over from the cranking mode to the normal mode (ordinate position) in FIG. 1A and is set larger for lower temperature as mentioned above. Also, after saving the fact that engine start is completed by clearing the flag FST to "0" in step S4, the routine proceeds to step S5.

When the above-mentioned flag FST is already cleared to "0" in step S2, the processes of steps S3 and S4 are skipped and the routine proceeds to step S5.

In step S5, it is decided whether or not the above-mentioned correction quantity Qst is equal to or less than "0". If the answer is "YES", which means that the oil temperature is high, i.e. the engine is warmed up, then the correction quantity Qst is compulsorily reset to "0" in step S6 and this routine ends.

If the answer is "NO" in step S5, which means that the engine is cold, then the routine proceeds to step S7 in which the timer is counted up from the initial value=0. Until it is found in step S8 that the count value CNT exceeds a fixed value CNT_Lv, steps S1–S8 are repeated. When the count value CNT is found to have exceeded the fixed value CNT_Lv, the count value CNT is cleared in step S9, the above-mentioned correction quantity Qst is decreased by a fixed quantity Qst_DEC (see FIG. 5) in step S10, and this routine ends.

Figure 5:
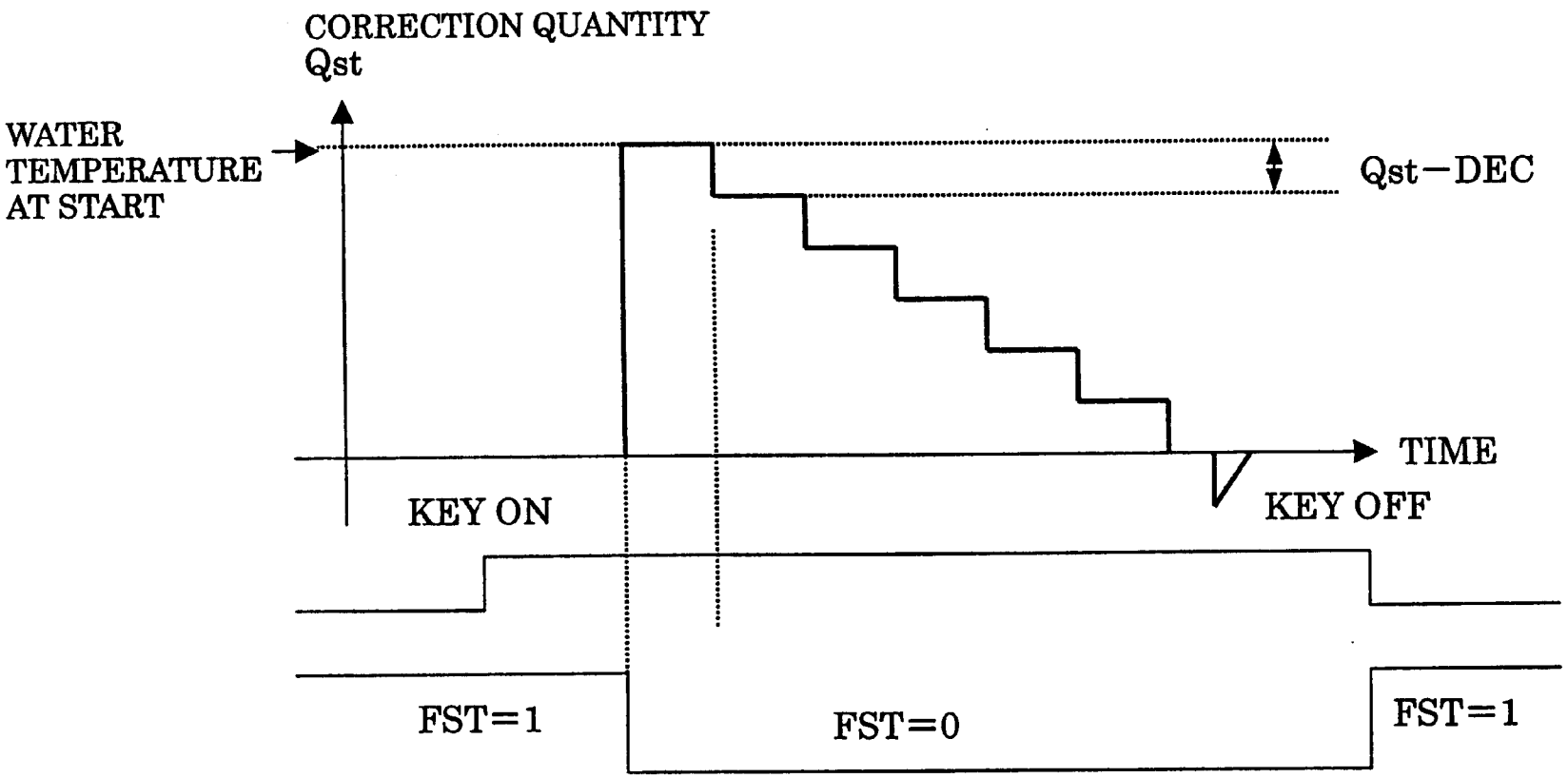
FIG. 5 is a graph illustrating an operation of the present invention in connection with the flow chart shown in FIG. 4.

It is to be noted that when executing this routine for the second or the subsequent time, since the flag FST is "0" (after engine start), the correction quantity Qst is further decreased by the fixed quantity of Qst_DEC as shown in FIG. 5 without executing steps S3 and S4. By repeating the above routine, the correction quantity (see FIGS. 1 and 5) can be obtained which is equivalent to the fall of the actual injection quantity in a short time after engine start.

Also, the present invention can be applied to a fuel hydraulic injection system as shown in the Japanese Patent Publication No. 4-19381 as well as a hydraulically actuated unit injector system.

It is to be noted that although the above-mentioned embodiment deals with such a correction control for the target injection quantity, it is needless to say that the pulse width (duty ratio) of an injection command pulse for the electromagnetic valve within the injector may be corrected.

As described above, the electronic fuel injection apparatus for a diesel engine according to the present invention is so arranged that when a driving state detection means indicates a state in a short time after engine start, a correction quantity which is preset to be added to a target injection quantity according to an engine temperature detected as the driving state may be decreased, depending on time after engine start, thereby eliminating engine stalls caused by insufficient actual injection quantity or an abnormal rising rate of engine speed and a large amount of white smoke caused by an excessive correction quantity in a short time after engine start.

What we claim is:

1. An electronic fuel injection apparatus for a diesel engine comprising;

a driving state detection means for detecting a driving state of a vehicle, and a controller for periodically determining a target injection quantity based on the driving, state, when the driving state detection means indicates a state in a short time after engine start, the controller decreasing a correction quantity which is preset to be added to the target injection quantity according to an engine temperature detected as the driving state, depending on time after engine start.

2. An electronic fuel injection apparatus for a diesel engine as claimed in claim 1 wherein the engine temperature comprises an engine water temperature.

3. An electronic fuel injection apparatus for a diesel engine as claimed in claim 1 wherein the engine temperature comprises an engine oil temperature.

4. An electronic fuel injection apparatus for a diesel engine as claimed in claim 1 wherein the driving state detection means detects a rotational speed and a load of the engine as the driving state.

5. An electronic fuel injection apparatus for a diesel engine as claimed in claim 1 wherein the driving state detection means detects a rotational speed and an idling state of the engine as the driving state.

6. An electronic fuel injection apparatus for a diesel engine as claimed in claim 1 wherein the driving state detection means comprises at least one of an intake pressure sensor for sensing an intake pressure of an intake pipe, a water temperature sensor for sensing an engine water temperature, and an intake temperature sensor for sensing an intake temperature of the intake pipe.

7. An electronic fuel injection apparatus for a diesel engine as claimed in claim 1, further comprising an injector actuated by oil pressure.

8. An electronic fuel injection apparatus for a diesel engine as claimed in claim 1, further comprising an injector actuated by fuel pressure.

9. An electronic fuel injection apparatus for a diesel engine as claimed in claim 1 wherein the controller corrects a pulse width of an injection command pulse for an electromagnetic valve disposed within an injector.

* * * * *